United States Patent [19]

Klaeger

[11] 3,932,990

[45] Jan. 20, 1976

[54] CLOSED LOOP BOOSTER SYSTEM PNEUMATIC ACTUATOR FOR OIL WELLS

[76] Inventor: Joseph H. Klaeger, 610 Chauncey, San Antonio, Tex. 78216

[22] Filed: Aug. 15, 1974

[21] Appl. No.: 497,695

Related U.S. Application Data

[63] Continuation-in-part of Ser. No. 421,844, Dec. 5, 1973, Pat. No. 3,933,175.

[52] U.S. Cl. ..... 60/369; 60/370; 60/456; 91/303; 91/304

[51] Int. Cl.[2] ..... F15B 1/00; F15B 13/042

[58] Field of Search ..... 60/369, 370, 371, 372, 60/407, 412, 456; 91/303, 304

[56] References Cited

UNITED STATES PATENTS

| | | | |
|---|---|---|---|
| 2,560,285 | 7/1951 | Habenicht | 91/304 X |
| 2,972,863 | 2/1961 | Hyde | 60/372 |
| 3,643,432 | 2/1972 | Klaeger | 60/412 |

*Primary Examiner*—Edgar W. Geoghegan
*Attorney, Agent, or Firm*—Willard J. Hodges, Jr.

[57] ABSTRACT

An improved closed loop pneumatic system for driving a piston in a cylinder which employs a low pressure tank for receiving exhaust gases, a booster compressor transferring the gases to a high pressure tank which drives the piston on the up stroke. The constant interconnecting of a low pressure tank through a piston pressure equalizing the line improves the efficiency of the actuator. The larger, deep-well system utilizes an improved means for recovering and recirculating lubricating oil within the closed loop. Two species of the invention are described in this application. One primarily designed for deep wells and one designed primarily for shallow wells.

6 Claims, 5 Drawing Figures

CLOSED LOOP BOOSTER SYSTEM PNEUMATIC ACTUATOR FOR OIL WELLS

CROSS REFERENCE

This application is primarily an improvement on certain features of your applicant's U.S. Pat. No. 3,643,432 and is related to U.S. Pat. No. 3,782,247. This application is a continuation in part of U.S. Pat. application No. 421,844 filed Dec. 5, 1973, now U.S. Pat. No. 3,933,175, issued Jan. 20, 1976, entitled "An Improved Snifter Valve Useful in Control Means for a Piston in a Cylinder".

BACKGROUND OF THE INVENTION

1. Field of the Invention

Pneumatic actuators for oil well pumps may be driven by well head gas; however, the impetus of this invention is an electric or deisel powered compressor used in combination with a multiplicity of control lines and conduits to efficiently drive a piston in a cylinder.

2. Description of the Prior Art

The current prior art is primarily your applicant's patents and products produced by and for Bravo Manufacturing Corp. and marketed throughout the world by Mid-Continent Oil Company.

Related pneumatic and gas operated systems have been devised and used in the past, but few if any have continued in production.

SUMMARY OF THE INVENTION

One feature of applicant's system contributing to the commercial success is the employment of the closed loop system to eliminate accumulation of water and impurities in the system. Once the air is compressed and used, the condensation may be drained off and the clean substantially moisture-free air recirculated. Small amounts of make-up air are added to the system to compensate for small losses and unavoidable seepage and leakage.

Economy of energy is present in the closed loop booster system in that variations in pressure between the low pressure tank and the high pressure tank minimize the energy required to perform the pumping task. There is little energy lost in the system of this invention. The individual components employed in the device of this invention are of the general construction and arrangement as described in your applicant's previous patents. The primary improvements incorporated in this invention reside in the utilization of the piston pressure equalizing line which almost instantaneously places a zero pressure load on the piston permitting the sucker rod string to fall of its own weight. This improved control feature results in a rapid down stroke and a slow up stroke insuring a full loading of the bottom hole pump. Another highly important feature is the closed loop quality of demoisturizing the working gases reducing freeze-up problems. The employment of low pressure air in the snifter valve control improves performance of the valves and increases valve life. In the deep well pumps an improved lubricating oil recovery and recirculating system has been developed increasing the life and efficiency of the units.

DESCRIPTION OF THE PREFERRED EMBODIMENT

Figure 1:
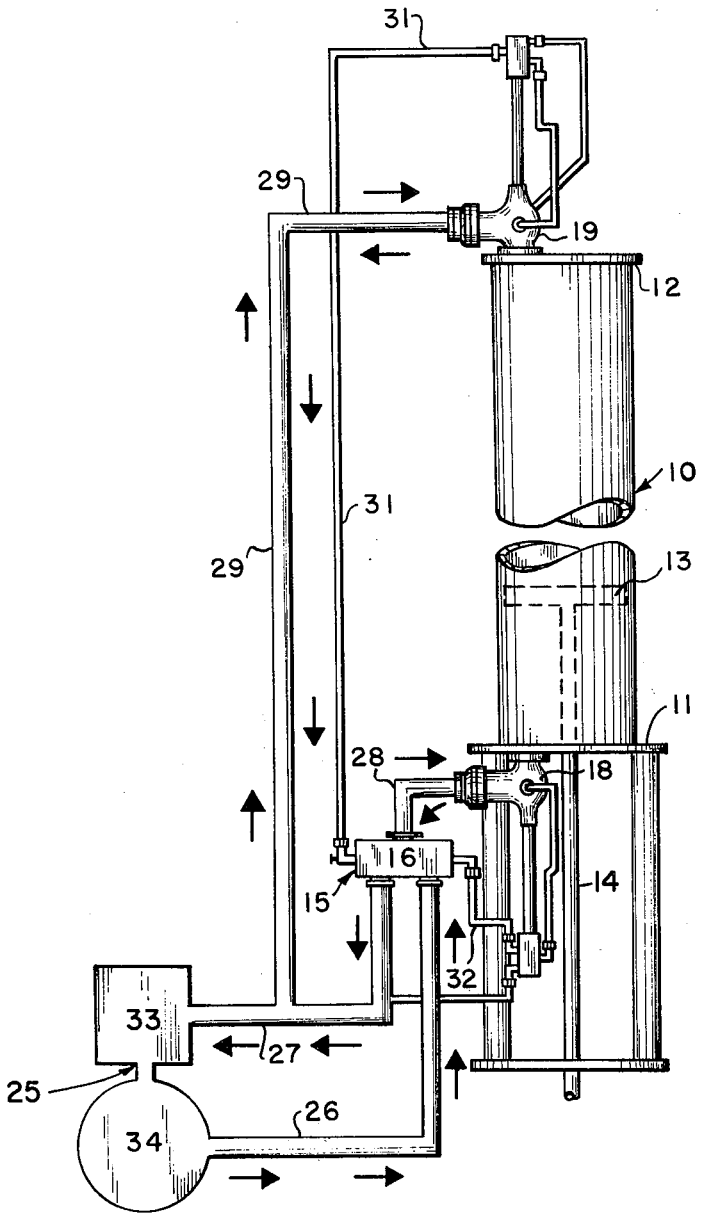
FIG. 1 is a schematic of the basic, least complicated form of the invention primarily intended to drive shallow well pumps.

For an illustration of the basic or simplest version of the system of this invention, particularly suited for driving shallow oil well pumps, attention is invited to FIG. 1. For general information as to methods of construction of the various components of the device of this invention, reference is made to your applicant's prior U.S. Pat. Nos. 3,643,432 and 3,782,247.

Figure 2:
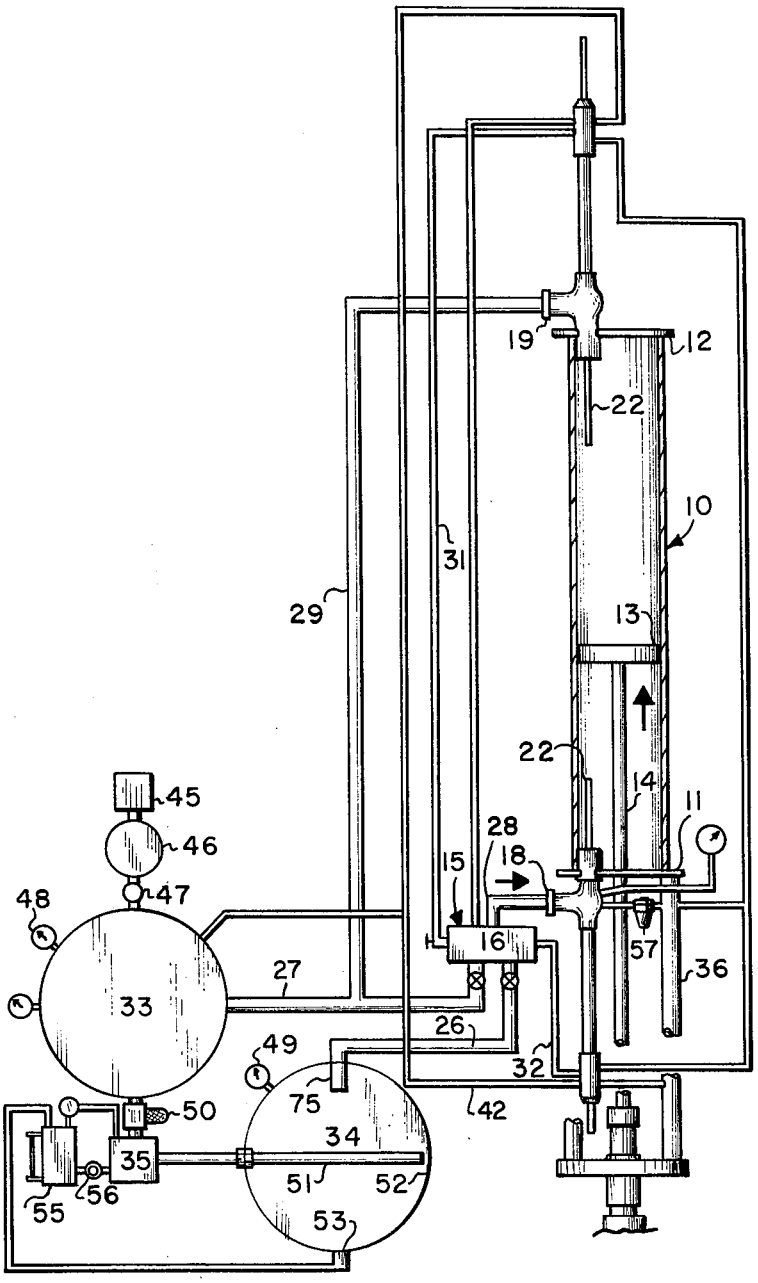
FIG. 2 is a schematic view of the invention incorporating several improved features, particularly adapting the device for deep wells.

Pumping cylinder 10 in the preferred embodiment was constructed from steel tubular member 8 or 10 inches on the inside diameter with the interior surface polished. Pumping cylinder bottom 11 is adjacent the well head. The top section of the cylinder is designated as pumping cylinder top 12. Piston 13 secured to piston rod 14 employs suitable sealing means to contact the interior of pumping cylinder 10. The control systems of this device are similar to your applicant's previous inventions disclosed in U.S. Pat. Nos. 3,643,432 and 3,782,247. The primary control system involves spool valve 15 comprising spool valve housing 16 in which is mounted floating piston 17 FIG. 3. The spool valve 15 employed is a standard commercial product marketed throughout the United States for controlling the flow of air or gases. Some embodiments of these valves have been patented. One example is U.S. Pat. No. 2,739,243 to Olson. Spool valve 15 is interconnected through control lines to bottom snifter valve 18 and top snifter valve 19 which control the operation of the system through contact with piston 13. For a description of the specific construction of these snifter valves, reference is made to your applicant's above cited patents. These devices basically include a snifter cylinder 20 to which is mounted a snifter piston 21 to which is secured snifter rod 22. The basic purpose and arrangement of the foregoing components is to regulate the flow of pressure fluid to and from the pressure power means 25, which is interconnected to the system through high pressure line 26 and low pressure line 27. The interconnection to pumping cylinder 10 is through bottom power line 28 communicating through bottom snifter valve 18 to pumping cylinder bottom 11. Top components of the device operate through piston pressure equalizing line 29 interconnected through top snifter valve 19 communicating with pumping cylinder top 12. This piston pressure equalizing line 29 is directly connected to low pressure line 27. Secured to and communicating with spool valve 15 is top control line 31 and bottom control line 32. The entire control system of this device is designed to control the flow of gas or air from pressure power means 25. Low pressure line 27 interconnects to low pressure tank 33 and high pressure line 26 interconnects to high pressure tank 34. Operably interconnected between low pressure tank 33 and high pressure tank 34 is booster compressor 35 as shown in FIG. 2. In the simplified version of the TM Pumping Unit of FIG. 1, pumping cylinder top 12 and piston pressure equalizing line 29 essentially serve as the low pressure tank 33. In the more sophisticated deep well pumping system of FIG. 2 a separate and distinct low pressure tank 33 is employed. The function of booster 35 is to receive exhausted gases from cylinder 10 and recompress them to an operating pressure into high pressure tank 34 for repetition of the pumping cycle.

An exceedingly important component of the so-called TM Pumping Unit resides in utilization of piston pressure equalizing line 29. When piston 13 arrives at the top of the stroke striking the snifter rod 22 releasing some pressure from top control line 31 the floating piston 17 shifts to the left venting the high pressure air from below piston 13 and pumping cylinder bottom 11. In operation of this component, the high pressure air passes through spool valve 15 to low pressure line 27 through its interconnection with piston pressure equalizing line 29 immediately equalizes or balances the pressure on each side of piston 13 permitting piston rod 14 to be drawn down by the weight of the sucker rods (not shown). The basic concept incorporating the simplified structure of this so-called TM Pumping Unit is as illustrated in FIG. 1 and comprises a complete operating structure.

Figure 3:
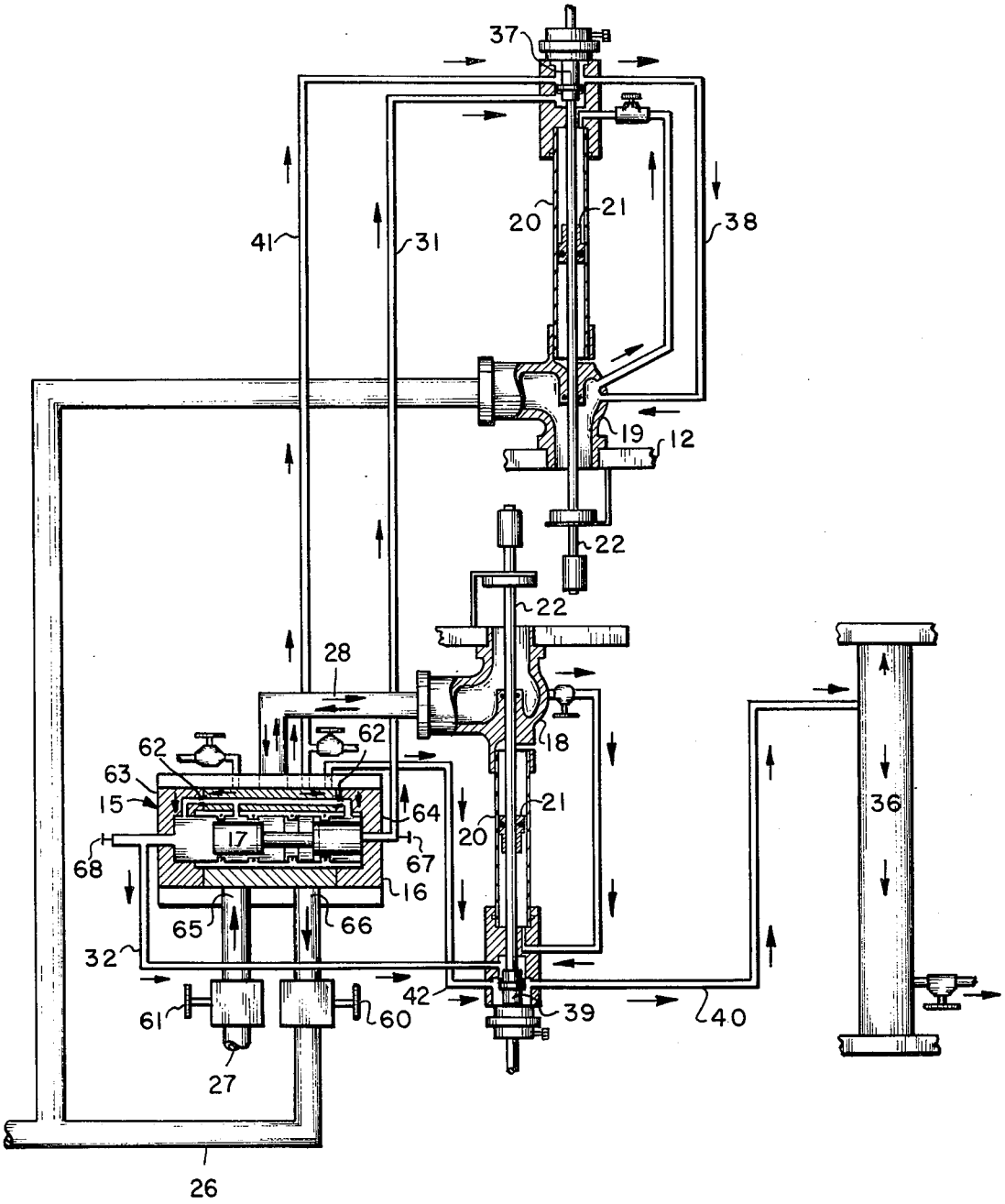
FIG. 3 is a fragmented view partially in section illustrating the detail of the spool valve, snifter valve control means and the piston pressure equalizing line of the so-called TM System.

For an illustration of the more sophisticated so-called TM System incorporating many improvements in detail of the structure, your attention is invited to FIGS. 2, 3, 4 and 5. These illustrations depict the embodiment of the device particularly suited for deep wells and operation under adverse climatic conditions having extreme ranges of temperature and in extremely cold climates. The improved spool valve control system is as substantially illustrated in FIG. 3. In this improved system, the control pressures in top snifter valve 19 and bottom snifter valve 18 are isolated and operated from low pressure gases utilizing one of the standing legs of the Klaeger Pumping Unit as a control pressure tank 36. This pressure tank 36 is directly connected to low pressure line 27 internal of spool valve 15. Surges in the system during operation cause gases to flow through the snifter valves 18 and 19 operating the valves as well as warming the components to prevent freezing. An opening of top bleeder vent 37 permits air to flow through top control line 31 moving floating piston 17 to the right as indicated in FIG. 3. Gases or air vented through bleeder vent 37 passes through control return line 38 communicating with the low pressure side of the system. In relation to the operation in the system of the bottom snifter valve 18 similar action occurs. A venting of the bottom bleeder vent 39 permits air to pass through bottom control line 32 flowing through reservoir return line 40 to control pressure tank 36. As previously stated, a flow from control pressure tank 36 is to the low pressure side of the system. Another important feature of the spool valve control system is the utilization of variations of pressure to prevent icing or freezing of bleeder vents 37 and 39. This is accomplished by the connection of top heat flow line 41 to the low pressure side of the spool valve and passing air through top snifter valve 19 around top bleeder vent 37 and returning the gas to the system through control return line 38. In a similar fashion the bottom heat flow line 42 leads from the low pressure side of spool valve 15 through bottom snifter valve 18 flowing warm gases around bottom bleeder vent 39 and through reservoir return line 40 back into the system. This enclosed circuit not only prevents loss of pressures in combination but also reduces operational difficulties in extreme climates, prevents contamination, and saves lubrication oil as will be later described and discussed.

Figure 4:
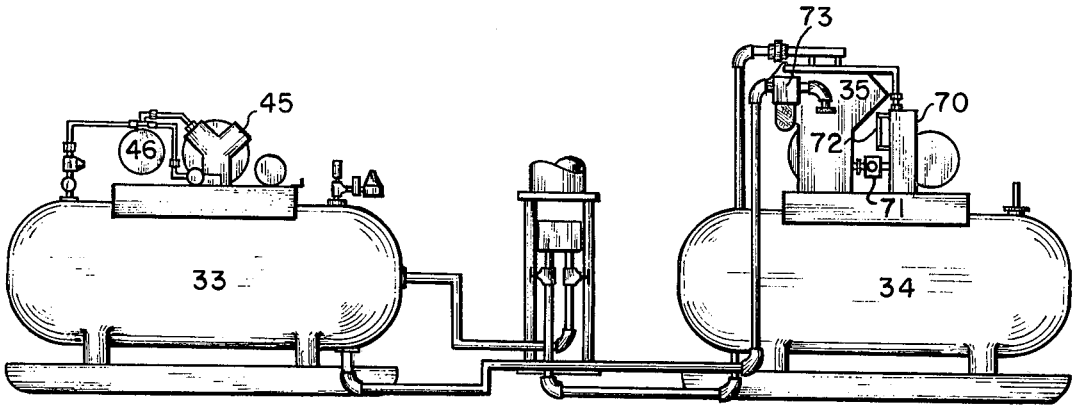
FIG. 4 is a detailed schematic of the power package for the deep well pump actuator system.

For a detailed illustration of the incorporation of the system, FIG. 3, in the overall combination your attention is invited to FIG. 2. In the schematic embodiment illustrated in FIG. 2 components and operation of the device are basically similar to FIG. 1; however, additional improved components are added to this system to adapt it for driving deep well pumps and the utilization of a more powerful and somewhat more complicated booster system of FIG. 4 and the oil recovery and recirculating system of FIG. 5. In addition to the features previously described in relation to FIG. 3 the booster system of FIG. 2 employs in association with low pressure tank 33 a make-up compressor 45 which may be a low horse power compressor compressing gas or air into control pressure tank 46 which is interconnected through make-up pressure regulator 47 to the low pressure tank 33. This system is designed to be utilized only when required to make up for seepage and losses in the closed system. Also utilized in conjunction with low pressure tank 33 is low pressure gauge 48. This is utilized in conjunction with selecting and balancing pressures to effectively operate the system. Also utilized in conjunction with high pressure tanke 34 is high pressure gauge 49. Forward of booster compressor 35 is positioned in the system a line filter 50 to collect any entrapped particles in the closed loop to prevent clogging or interference with the operation of the spool valve 15 or snifter valves 18 or 19. An important feature of the booster power package, FIG. 4, is the oil recovery system illustrated somewhat in detail in FIG. 5 and incorporated schematically in FIG. 2. The most efficient compressors discovered to operate this system were air conditioner compressors of the appropriate size and specifications. These compressors lend themselves to utilization of suspended oil in the air or gas to lubricate the system internally as well as being adapted to receiving intake gas under pressure and exhaust the gas or air at a higher pressure. In regard to the oil recovery system, reference is made to FIGS. 2, 4 and 5. The air discharge line 51 leading from booster compressor 35 projects into high pressure tank 34 substantially through the mid section of the tank and terminates adjacent a wall of tank 34. The function of this structure is to cause the wall of pressure tank 34 to serve as baffle section 52. The striking of the wall by the air moving through air discharge line against baffle 52 changes the direction of the air and removes suspended particles of lubricating oil carried by the air. This oil collects on the interior wall of high pressure tank 34 and flows to the bottom of tank 34 for return to the system through oil port 53 which leads through oil return line 54 to oil reservoir 55. Oil reservoir 55 is connected through an oil level control 56 to compressor booster 35. In this operation it was found desirable to place oil reservoir 55 under compression of approximately 10 psi more than the booster crank case pressure to insure or accomplish adequate flow into the compressor 35. This is accomplished by means of oil pressure regulator 57 which maintains a constant differential pressure of 10 psi on the reservoir 55. The internal lubrication of this system is accomplished very similar to home and industrial air conditioners wherein the lubricant is suspended in the refrigerant circulated through the system. Air or gas recirculates oil through the system of this device lubricating all internal components.

OPERATION

For an explanation of the spool valve 15, snifter valve 18, 19 control system, reference is made to FIG. 3. In placing the unit into operation initially suction valve 60 on the unit is opened three-fourths of a turn. High pressure valve 61 is opened at this time and fluid pressure enters spool valve 15. In the spool valve body 16 a small internal passageway incorporating restrictors 62 admits pressure from high pressure line 26 into the left end 63 and the right end 64 of spool valve body 16. This allows the restricted high pressure to be exerted on each end of spool 17 at all times. This same high pressure is exerted against top bleeder vent 37 and bottom bleeder vent 39 which seal bottom snifter valve 18 and top snifter valve 19. These vents 37 and 39 effect seal between the high pressure line 26 of the system and the low pressure line 27 of the system. With snifter 19 in the uppermost position high pressure is blocked to the pumping cylinder top 12. When top bleeder vent 37 is open high pressure from top control line 31 is released to the low pressure side of the system through control line 38 allowing the pressure to drop immediately creating a differential pressure on opposite ends of spool valve 17. High pressure on the opposite end immediately drives spool 17 to the right end of housing 16. The construction and operation of the top snifter valve 19 and the bottom snifter valve 18 are identical. If bottom snifter valve 18 is moved downward opening vent 39 this allows the high pressure gas in the left end of spool 17 to exhaust into the low pressure side allowing the spool 17 to shift back to the left side of housing 16.

When the spool 17 is shifted to the left side of spool valve housing 16 high pressure is allowed to enter cylinder 10 and lift piston 13 and the sucker rod string (not shown) on the upstroke. When spool 17 shifts to the right, the high pressure port 65 is closed, and low pressure port 66 is opened and a down stroke occurs. This allows high pressure beneath piston 13 to expand into the low pressure suction system. This allows pressure beneath piston 13 through piston pressure equalizer line 29 to try and equalize with the pressure above piston 13. In actual operation the only time pressure will completely equalize is when a slight hesitation is realized on the down stroke. This would allow the air escaping from beneath the piston 13 time to equalize pressure in pumping cylinder top 12. Sucker rod weight in the system ordinarily never allows the pressures to completely equalize on each side of piston 13. However, a fast down stroke is usually achieved. As described above, the operation of the snifter valves 18 and 19 in the control system illustrates, in summary, the shifting of spool valve 17 operating the control system.

The start-up procedure of the unit is substantially as follows:

Upon the partial opening of high pressure valve 61 the control system is pressurized. Top snifter valve 19 closes and lower snifter valve 18 cannot close because of contact with piston 13 at the bottom of the stroke which holds lower snifter valve 18 in the open position. This position causes spool valve 17 to shift to the left allowing high pressure to enter cylinder 10. As piston rod 14 moves upward, thrust air on the lower control system forces snifter rod 22 to follow main piston 13 upward until bottom bleeder vent 39 of bottom snifter valve 18 is closed. The left end of spool valve 17 is pressurized, main piston 13 and piston rod 14 continue upward until piston 13 engages top snifter rod 22 forcing it and top bleeder vent 37 upward breaking the seal, allowing high pressure on the right end of spool valve 17 to exhaust into the low pressure system through control return line 38. High pressure on the left end of housing 16 drives spool 17 to the right, closing high pressure port 65 and opening low pressure port 66, causing the main piston 13 to move downward. Top snifter valve rod 22 follows and closes top bleeder vent 37. When main piston 13 engages bottom snifter rod 22 opening bottom bleeder vent 39 spool valve 17 shifts initiating another cycle. At any time a snifter valve rod 22 is engaged the opening of the bleeder vents 37 or 39 causes the spool 17 to shift. Spool valve 15 is provided with an overriding right bleeder button 67 and left bleeder button 68 at each end of spool housing 16. The spool 17 can be shifted at any time by depressing either of these buttons 67 and 68. When buttons 67 and 68 are depressed it allows pressure to exhaust from the side of spool valve housing 16 causing spool 17 to shift. Top control assembly and bottom control assembly are virtually identical in construction and operation.

Figure 5:
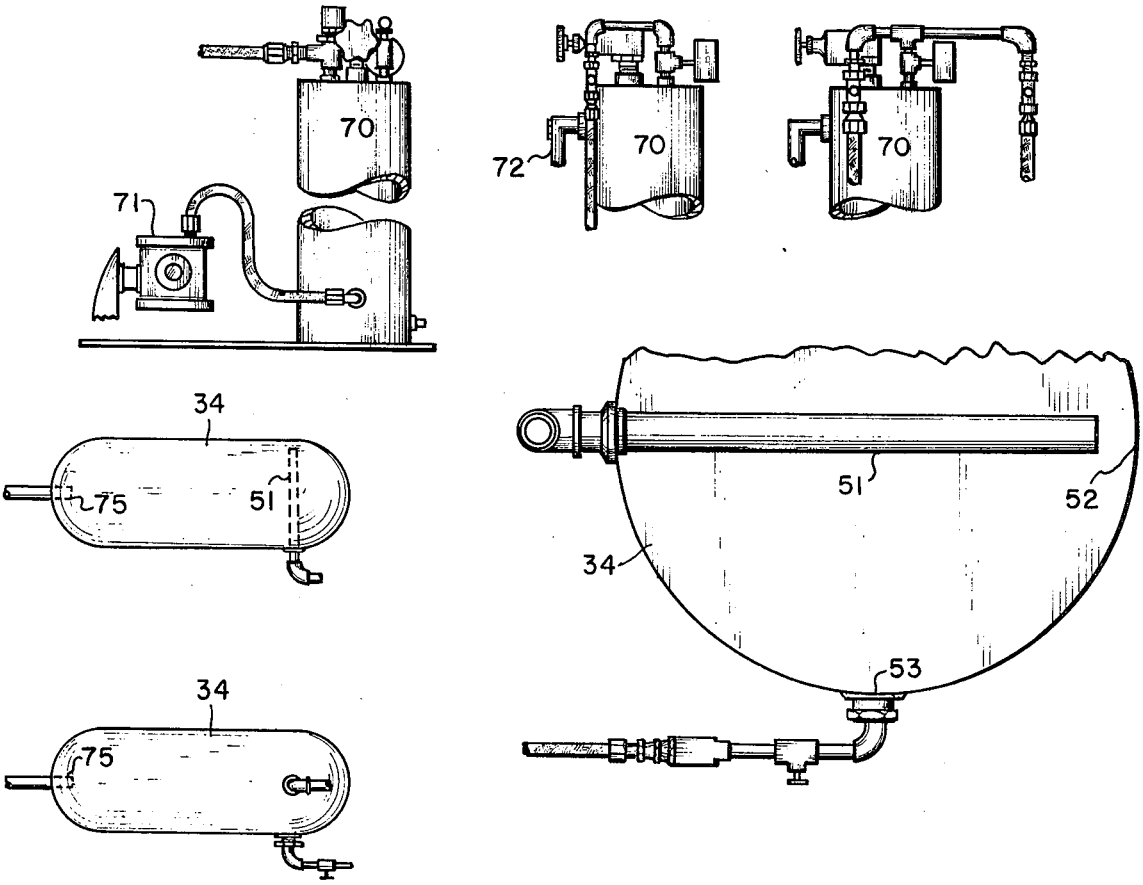
FIG. 5 is a fragmented, detailed schematic illustrating the oil recovery means in the closed loop system for deep well pumps.

For an illustration of the operation of the lubricating system in the booster system your attention is invited to FIGS. 4 and 5. Booster compressor 35 is designed in such a fashion as to permit a small quantity of oil to leave the crankcase as a mist with air or gas being used in the system. This oil travels through the entire system lubricating all moving parts. In the booster system employed with deep well pumps as illustrated in detail in FIGS. 4 and 5 each booster power package is equipped with a two gallon oil reservoir 70 and an oil level regulator 71 as well as a sight gauge and line filter 73. In this larger unit, more oil is discharged from the booster than is necessary to lubricate the unit. The high pressure tank 34 is utilized as an oil-gas separator. The oil enters the tank 34 through air discharge line 51 and strikes a portion of high pressure tank 34 designated as baffle area 52. This change of direction of flow of the gas results in oil being collected on the surface of tank 34. Oil is returned to the system through oil port 53 and return to reservoir 70. Gas leaves high pressure tank 34 through a header pipe 75 which projects three or four inches into the interior of tank 34. The header pipe extension prevents oil clinging to the wall of tank 34 from continuing through the system and causes the oil to gravitate to the bottom of the tank 34. The foregoing description sets forth in detail some of the refinements of this improved booster system incorporating features constituting the TM System of this invention.

It will be apparent to those skilled in the arts from a study of this description and the detail of the drawing that certain modifications of this system may be made. What is desired to be claimed is all modifications or rearrangements not departing from the scope of the equivalents of the invention as defined in the appended claims.

I claim:

1. An improved actuator for oil well pumps comprising:

a. an elongated cylinder, b. a piston movably positioned in said cylinder dividing said cylinder into a top end and a bottom end, c. a floating piston three-way spool valve having a low pressure port and a high pressure port and a cylinder port, d. a top snifter valve operably secured to the top end of said cylinder, e. a bottom snifter valve operably secured to the bottom end of said cylinder, f. a bottom power line interconnecting the cylinder port of said three-way valve and said bottom snifter valve, said bottom power line adapted to flow gases to and from said bottom snifter valve, g. a low pressure line leading from said low pressure port of said three-way valve, h. a high pressure line leading from said high pressure port of said three-way valve, i. a piston pressure equalizing line interconnecting the said low pressure line and the pumping cylinder top end through the said top snifter valve, j. a top control line operably interconnecting said top snifter valve and a first end of said floating piston three-way spool valve, k. a bottom control line operably interconnecting said bottom snifter valve and a second end of said floating piston three-way spool valve, l. a booster means interconnecting said low pressure line and said high pressure line, said booster means receiving low pressure gases and compressing said gases and returning said gases to the high pressure line, m. said top snifter valve and said bottom snifter valve in conjunction with said control lines and said floating piston three-way valve controlling the flow of high pressure gases to said cylinder and the flow of low pressure gases from said cylinder.

2. The invention of claim 1 including:

a. a heat flow-through line interconnecting the high pressure port of said floating piston spool valve and the top bleeder vent of said top snifter valve and said low pressure line, and b. a heat flow-through line interconnecting the high pressure port of said floating piston spool valve and the bottom bleeder vent of said bottom snifter valve and said low pressure line.

3. The invention of claim 1 including an enclosed loop spool valve control system comprising:

a. an internal passage in the body of said spool valve interconnecting the high pressure port of said valve and each end of said spool valve, b. a bottom control line leading from the first end of said spool valve to a bottom bleeder vent, c. a reservoir return line interconnecting said bottom bleeder vent and said low pressure line, d. a top control line leading from a second end of said spool valve to a top bleeder vent, and e. a control return line leading from said bleeder vent to said low pressure line.

4. The invention of claim 1 wherein said booster means comprises:

a. a low pressure tank connected to said low pressure line, b. a high pressure tank connected to said high pressure line, c. a booster compressor having a crankcase interconnected through a regulator means juxtaposed between said low pressure tank and high pressure tank maintaining said high pressure tank at a selected pressure, and d. a make-up compressor interconnected through a regulator means for maintaining said low pressure tank at a selected pressure.

5. The invention of claim 4 including an oil recirculating means comprising:

a. an oil reservoir, b. an air discharge line leading from said booster compressor entering through a wall of said high pressure tank terminating adjacent an opposite wall of said high pressure tank, c. an oil port adjacent the bottom of said high pressure tank, d. conduit means interconnecting said oil port and said reservoir, and e. a header pipe projecting into said high pressure tank for admitting high pressure gas to said high pressure line.

6. The invention of claim 4 including internal oiling means comprising:

a. an oil mist means for passing a mist of oil from the crankcase of said booster compressor into the gas being compressed, b. a reservoir connected to said crankcase of said booster compressor, c. oil pressure means for maintaining said reservoir under a selected pressure feeding said crankcase of said booster compressor, and d. regulator means for maintaining a constant level of oil in said booster compressor crankcase.

* * * * *